US006855069B2

(12) United States Patent
Nagai et al.

(10) Patent No.: US 6,855,069 B2
(45) Date of Patent: Feb. 15, 2005

(54) GAME IMPROVEMENT GOLF CLUB USING HOLLOW TECHNOLOGY

(75) Inventors: Masao Nagai, Suwanee, GA (US); David G. Llewellyn, Duluth, GA (US)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/209,301

(22) Filed: Jul. 31, 2002

(65) Prior Publication Data

US 2004/0023729 A1 Feb. 5, 2004

(51) Int. Cl.[7] ..... A63B 53/04

(52) U.S. Cl. ..... 473/335; 473/338; 473/345; 473/350

(58) Field of Search ..... 473/324, 334, 473/335, 336, 337, 338, 339, 345, 346, 349, 350, 290, 291, 292; D21/747, 748, 749, 750, 751, 759

(56) References Cited

U.S. PATENT DOCUMENTS

| | | | | | |
|---|---|---|---|---|---|
| D244,558 | S | * | 5/1977 | Elkins, Jr. | D21/750 |
| 4,398,965 | A | | 8/1983 | Campau | |
| 4,645,207 | A | * | 2/1987 | Teramoto et al. | 473/290 |
| 5,090,702 | A | | 2/1992 | Viste | |
| 5,184,823 | A | | 2/1993 | Desboilles et al. | |
| 5,328,175 | A | * | 7/1994 | Yamada | 473/346 |
| 5,499,819 | A | * | 3/1996 | Nagamoto | 473/346 |
| 5,755,627 | A | * | 5/1998 | Yamazaki et al. | 473/345 |
| 5,833,551 | A | * | 11/1998 | Vincent et al. | 473/350 |
| 5,913,735 | A | * | 6/1999 | Kenmi | 473/338 |
| 5,941,782 | A | * | 8/1999 | Cook | 473/346 |
| 5,967,903 | A | | 10/1999 | Cheng | |
| 6,059,669 | A | * | 5/2000 | Pearce | 473/339 |
| 6,162,133 | A | * | 12/2000 | Peterson | 473/345 |
| 6,440,010 | B1 | * | 8/2002 | Deshmukh | 473/335 |
| 6,454,665 | B2 | * | 9/2002 | Antonious | 473/346 |
| 6,533,679 | B1 | * | 3/2003 | McCabe et al. | 473/335 |
| 6,592,468 | B2 | * | 7/2003 | Vincent et al. | 473/334 |

* cited by examiner

*Primary Examiner*—Sebastiano Passaniti
(74) *Attorney, Agent, or Firm*—Troutman Sanders LLP; Gerald R. Boss

(57) ABSTRACT

A golf club head comprising of a top, a sole, a toe, a heel, a front plate having a front and rear side, and an extended back portion integral with the sole and the rear side defining a cavity wherein the extended back portion is integral with the rear side between the top and the sole of the golf club head.

2 Claims, 2 Drawing Sheets

GAME IMPROVEMENT GOLF CLUB USING HOLLOW TECHNOLOGY

BACKGROUND OF THE INVENTION

Game improvement golf clubs are designed to have a large "sweet spot" to allow golf shots that are not struck on the center of the golf club face to still travel to their intended target. Since many golfers often do not strike the golf ball in the center of the golf club face, a larger "sweet spot" can significantly improve golf scores. Having a large "sweet spot" really means that the golf club head has a large moment of inertia.

Moment of inertia is important in golf because not all shots are struck in the middle of the golf club. Generally, shots struck on the toe of the golf club will cause the golf club to rotate clockwise causing the ball to travel to the right. Golf shots struck on the heel of the golf club will cause the golf club to rotate counter clockwise causing the ball to travel to the left. The club rotation not only affects the direction that the ball travels, but the tilt of the golf club also consumes energy causing the ball to travel a shorter distance as well. If a golf club head has a larger moment of inertia, then the golf club head is less apt to rotate. Therefore, golf shots that are struck on the toe or heel travel farther and straighter. These clubs are thought to have a larger "sweet spot."

Moment of inertia is rotational inertia. It describes the force necessary to rotate an object around an axis. The larger the moment of inertia of an object, the harder it is to rotate the object around that axis. Moment of inertia of an object is determined by the distribution of the mass of an object around an axis. For a given total mass, the moment of inertia is greater if more mass is farther from the axis than if the same mass is distributed closer to the axis. For this reason, golf clubs have been made that distribute the majority of the weight of the golf club around the perimeter of the face of the golf club as opposed to the middle of the face to increase the moment of inertia relative to rotation of the golf club head around the middle of the face.

Metal woods were the first type of golf club to increase their moment of inertia by developing a hollow interior inside the golf club head. By removing mass located near the center of gravity of the golf club head, metal woods were able to significantly increase their moment of inertia. However, this technology has not been effectively introduced for irons. The few irons that use hollow technology lack the solid feel of traditional forged irons and are not designed to optimize the moment of inertia of the golf club head.

The problem with most current game improvement clubs that have a large moment of inertia is that the large moment of inertia was created by removing mass directly behind the striking area. While the large moment of inertia allows better performance for balls struck off-center, these clubs lack the solid feel of traditional forged clubs because of the lack of mass directly behind the striking area.

Another disadvantage of most game improvement clubs is that they fail to address one of the more common problems that face high-handicap golfers. Most high handicap golfers have difficulty elevating iron shots, especially low lofted irons. One of the reasons that low lofted irons are more difficult to elevate is that as the loft decreases, the center of mass of the golf club head moves higher up the face making it more difficult to elevate the golf ball. It is therefore advantageous to lower the center of gravity of irons to increase the launch angle of the golf ball.

Accordingly, it is an object of the present invention to provide a game improvement golf club iron that has a hollow interior, a large moment of inertia, a lower center of gravity, and a reinforced striking area.

SUMMARY OF THE INVENTION

The present invention contemplates a novel and improved game improvement golf club.

The present invention is a golf club head comprising of a top, a sole, a toe, a heel, a front plate having a front and rear side, and an extended back portion integral with the sole and the rear side defining a hollow interior wherein the extended back portion is integral with the rear side of the front plate between the top and the sole of the golf club head.

An object of this invention is to reinforce the striking area of the golf club head described above to create a feel that is more like a traditional forged iron.

Another object of this invention is to provide a golf club head as described above that utilizes toe and heel weighting elements or perimeter weighting elements.

Another object of this invention is to disclose a manufacturing process for the above described golf club heads.

DETAILED DESCRIPTION OF THE INVENTION

Figure 1:
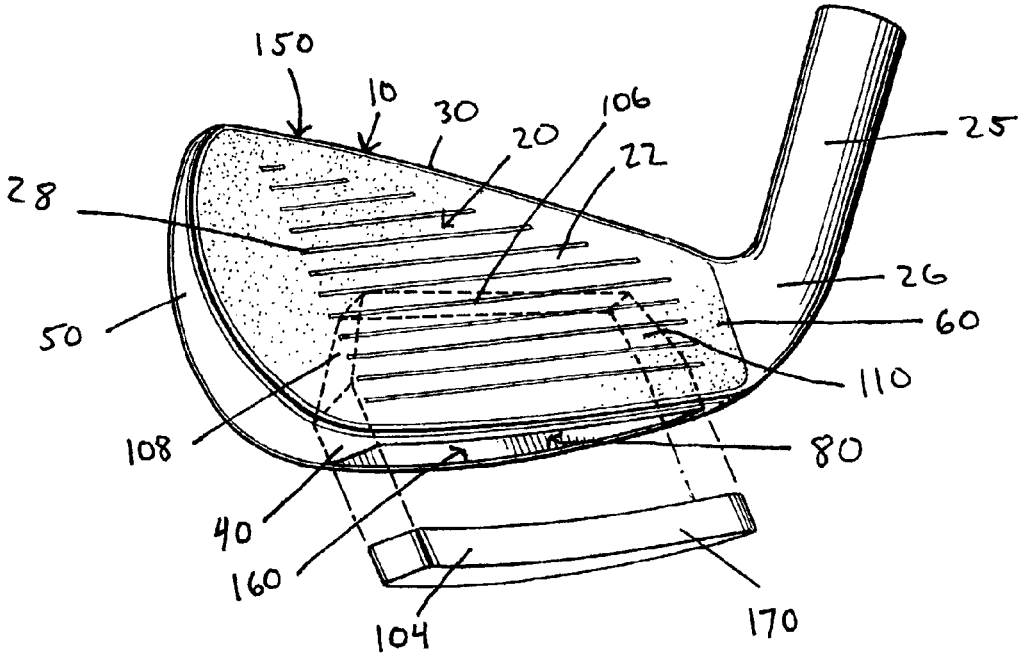
FIG. 1 is a front view of an iron type golf club head showing a detached sole component with dotted lines defining a hollow interior portion of the golf club head.

Referring now in more detail to the drawings, as can be seen in FIGS. 1–4, a golf club head 10 includes a front plate 20 having two sides, a front side 22 and a rear side 24, a top 30, a sole 40, a toe 50, a heel 60, and an extended back portion 70 integral with the rear side of the front plate 20 and sole 40 which defines a hollow interior 80 where the extended back portion is integral with the rear side of the front plate between the top and the sole of the golf club head.

In one embodiment as shown in FIG. 1, front plate 20 is preferably constructed from a material that is bendable to allow for custom fitting of the golf club. A hosel 25 connects to the front plate 20 to allow a golf shaft to be attached to the golf club head. The hosel 25 also includes a neck 26 connected to the heel portion of the front plate 20. Front plate 20 also has a series of grooves 28 on the front side of the front plate 22. Each groove in this embodiment is approximately 0.4 mm deep and 0.8 mm wide and is spaced 3.5 mm apart from each other. There are two sets of grooves, one set having equal length grooves and another set having varying length grooves. A set of golf club heads typically contain irons having varying lofts, bounce angles, and lie angles whose values and variations would be know to those skilled in the art.

Figure 3:
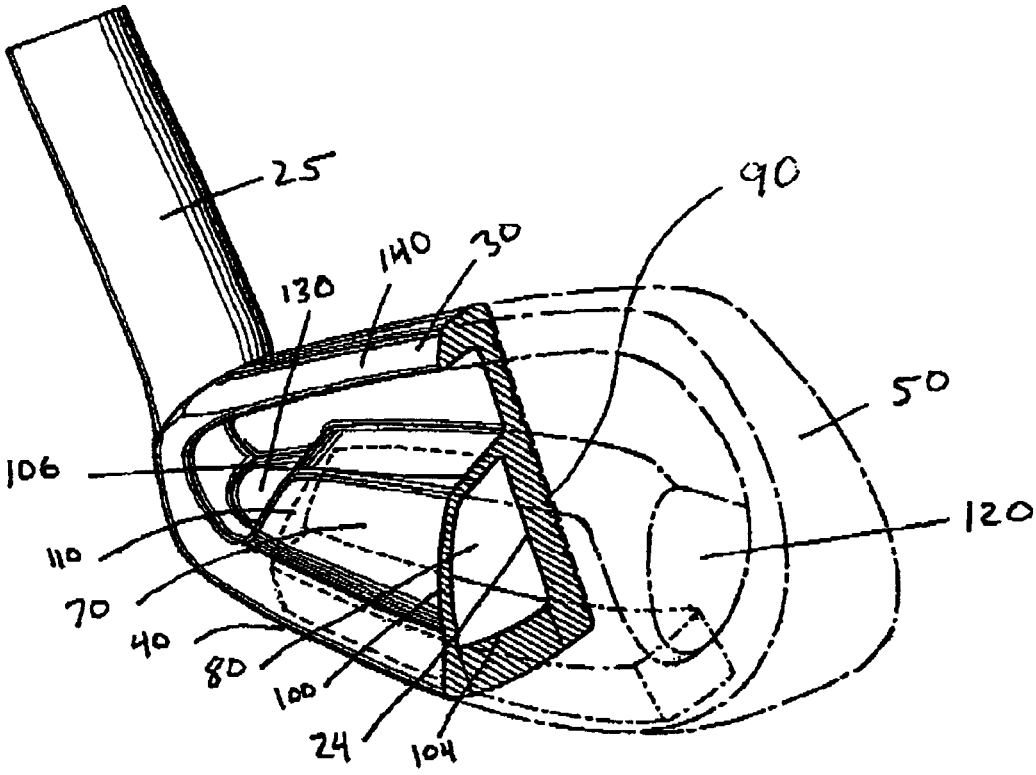
FIG. 3 is a sectional view of FIG. 2 showing the hollow interior of the golf club head.
Figure 4:
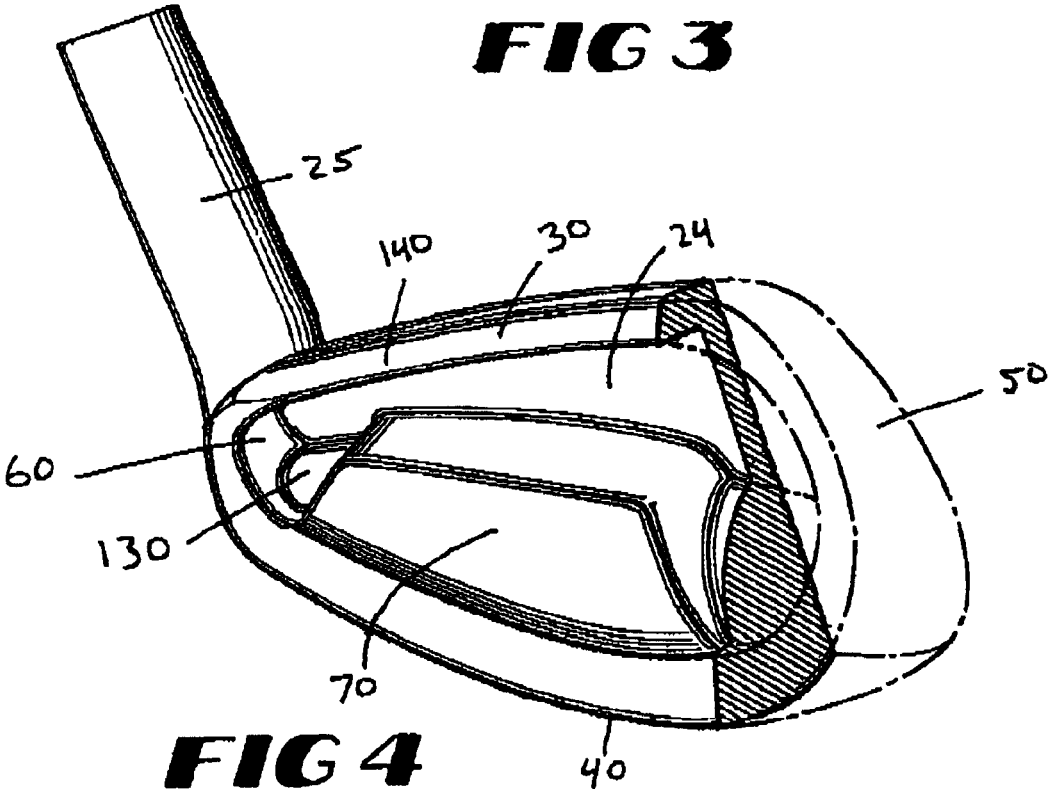
FIG. 4 is a sectional view of FIG. 2 showing the solid toe portion of the golf club head.

As shown in FIG. 3, the front plate 20 can also have a reinforced striking area 90. Because the front side of the front plate 22 strikes the golf ball, the rear side of the front plate 24 is reinforced around the area of the front plate that typically contacts the golf ball at impact. This reinforced striking area 90 makes the club feel more like a forged club. One of the major complaints of perimeter weighted clubs is that because the majority of the weight of the club is distributed around the perimeter of the club instead of behind the striking area, these clubs lack a solid feel upon impact with a golf ball. Because of the effect that a hollow interior 80, a large sole 40, and perimeter weighting have on the center of gravity and moment of inertia of the golf club head, a reinforced striking area 90 can be added to a golf club head 10 to help retain the solid feel of a forged club while still retaining a large moment of inertia and a low center of gravity.

The sole 40 can also be reinforced with extra material to increase the amount of weight located in the lower portion of the golf club head to lower the center of gravity of the golf club head. Lowering the center of gravity increases the launch angle of a golf ball upon impact with the golf club head because the mass of the golf club head below the center of gravity of the golf ball is increased.

As shown in FIG. 1 and FIG. 3, the hollow interior 80 is preferably defined by six walls: a portion of the extended back portion defines a back wall 100, a portion of the front plate defines a front wall 102, a portion of the sole defines a bottom wall 104, a portion of the extended back portion defines a top wall 106, and two side walls 108 and 110 that extend from the top wall 106 to the sole 40 between the toe 50 and the heel 60 of the golf club head. All of these walls with the exception of the front wall 102, have the effect of moving the center of gravity of the golf club head deeper behind the front portion of the front plate 22. In addition, all of these walls also have the effect of increasing the moment of inertia of the golf club head because more mass is distributed away from the axis that the golf club rotates around upon impact with a golf ball on either the toe or heel portion of the golf club. In one embodiment, these walls define a trapezoid-like shape.

In addition, in one embodiment, the shape of the hollow interior 80 can vary according to the loft of the club to maintain a constant center of gravity height. To maintain a constant center of gravity height, low lofted irons would have a shorter, wider hollow interior 80 because the upright front plate 20 of the golf club head would otherwise tend to raise the height of the center of gravity. For the same reasons, high lofted irons would have a relatively taller, narrower hollow interior 80 due to the fact that the front plate 20 of these clubs would tend to be less upright.

Figure 2:
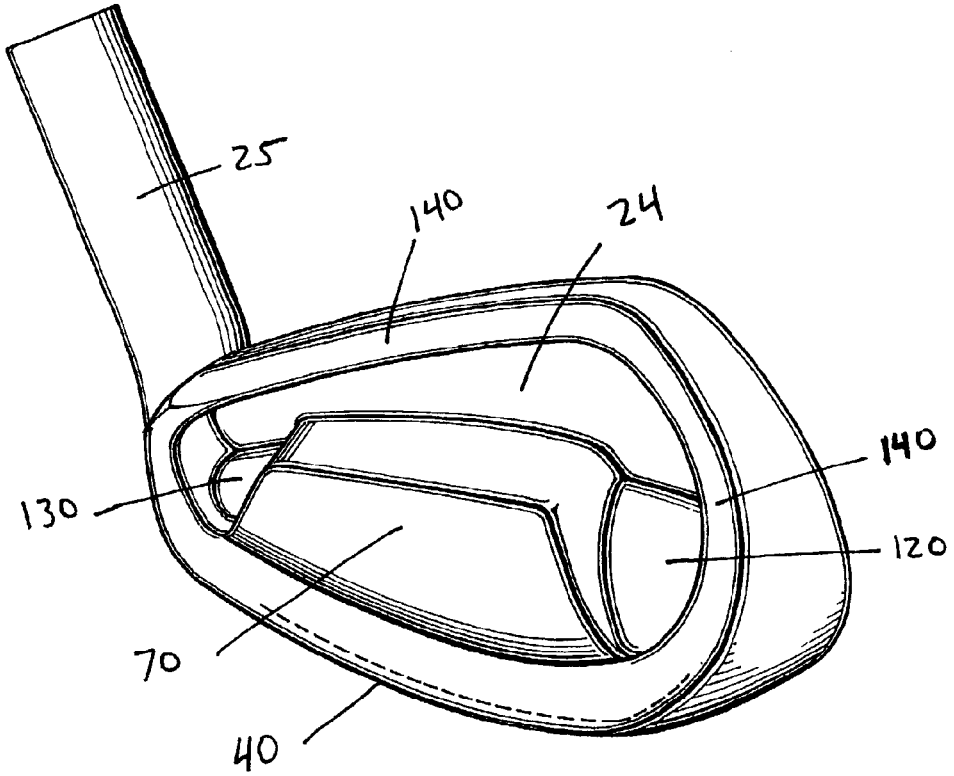
FIG. 2 is a rear view of the golf club head shown in FIG. 1.

As shown in FIG. 2, to further increase the moment of inertia, perimeter weighting elements, a toe weighting element 120 and a heel weighting element 130, can be added to the toe and heel portions of the golf club head thereby increasing resistance to twisting of the golf club as a result of the front plate 20 impacting a golf ball near either the toe or heel portion of the golf club head. The toe weighting element 120 could be located on the rear side of the front plate 24 between the side wall 108 of the hollow interior and the toe of the club 50, and the heel weighting element 130 could be located on rear side of the front plate 24 between the side wall of the hollow interior 110 and the heel of the club 60. Since the shaft is connected to the heel of the golf club head, the toe weighting element 120 would generally be larger than the heel weighting element 130 because the shaft and the hosel 25 act as additional weight in the heel of the club as illustrate in FIG. 2. However, variations as to the size and shape of these weighting elements are well known to those skilled in the art. In addition to the toe and heel weighting elements, one embodiment of this golf club head is fitted with a perimeter weighting element 140 along the periphery of the rear side of the front plate. One embodiment of a perimeter weighting element 140 is illustrated in FIG. 2, but other variations of perimeter weighting elements would be known to those skilled in the art.

As shown in FIG. 1, the method of manufacture of the golf club heads includes the steps of casting of a primary body 150 wherein the primary body 150 has an extended back portion 70 integral with the front plate 20 which defines an open cavity 160 with an opening at the sole of the club where the open cavity 160 has a top wall 110 disposed between the top 30 and the sole 40 of the club and abuts the rear side 24 of the front plate. A sole component 170 is manufactured and attached to the primary body 150 to incase the open cavity 160. The sole component 170 can be attached to the primary body 150 by welding.

What is claimed is:

1. A golf club head comprising:

a top, a sole, a toe, a heel, a front plate having a front and rear side, and an extended back portion integral with said sole and said rear side defining a hollow interior wherein said extended back portion is integral with said rear side between said top and said sole of the golf club head wherein sand hollow interior has a first side wall in communication with said sole between said heel and said toe and a second side wall in communication with said sole between said first side wall and said toe and wherein a heel weighting element is carried by said rear side between said first side wall and said heel and a toe weighting element is carried by said rear side wall between said second side wall and said toe.

2. A golf club head comprising:

a cop, a sole, a toe, a heel, a front plane having a front and rear side, and an extended back portion, said extended back portion integral with said sole and said rear side, said extended back portion, said rear side and said sole defining an enclosure having a hollow interior wherein said extended back portion is integral with said rear side between said top and said sole of the golf club head; wherein said hollow interior has walls that define a substantially trapezoidal shape.

* * * * *